US010183769B2

(12) United States Patent
Figiel et al.

(10) Patent No.: US 10,183,769 B2
(45) **Date of Patent: *Jan. 22, 2019**

(54) SEALING TOOL FOR STRAP

(71) Applicant: Signode Industrial Group LLC, Glenview, IL (US)

(72) Inventors: Janusz Figiel, Mundelein, IL (US); Ka Kuen Leung, Antioch, IL (US); Jason R. Nasiatka, Northbrook, IL (US); John W. Croll, Chicago, IL (US)

(73) Assignee: SIGNODE INDUSTRIAL GROUP LLC, Glenview, IL (US)

( * ) Notice: Subject to any disclaimer, the term of this patent is extended or adjusted under 35 U.S.C. 154(b) by 385 days.

This patent is subject to a terminal disclaimer.

(21) Appl. No.: 15/052,488

(22) Filed: Feb. 24, 2016

(65) Prior Publication Data

US 2016/0167814 A1 Jun. 16, 2016

Related U.S. Application Data

(63) Continuation of application No. 13/618,686, filed on Sep. 14, 2012, now Pat. No. 9,272,799.

(60) Provisional application No. 61/543,161, filed on Oct. 4, 2011.

(51) Int. Cl.

| | |
|---|---|
| ***B65B 13/30*** | (2006.01) |
| ***B65B 13/02*** | (2006.01) |
| ***B65B 13/18*** | (2006.01) |

(52) U.S. Cl.

CPC ..... *B65B 13/305* (2013.01); *B65B 13/025* (2013.01); *B65B 13/187* (2013.01)

(58) Field of Classification Search

CPC ... B65B 13/025; B65B 13/185; B65B 13/187; B65B 13/30; B65B 13/305

See application file for complete search history.

(56) References Cited

U.S. PATENT DOCUMENTS

| | | | | |
|---|---|---|---|---|
| 1,952,092 | A | 3/1934 | Porter | |
| 2,076,276 | A | 4/1937 | Porter | |
| 3,144,888 | A | 8/1964 | Palmer | |
| 3,194,281 | A | 7/1965 | Frey et al. | |
| 3,396,760 | A | 8/1968 | Kirsinas et al. | |
| 4,154,158 | A | 5/1979 | Crosby et al. | |
| 4,159,725 | A * | 7/1979 | Bachmann | B65B 13/305 140/93.2 |

(Continued)

FOREIGN PATENT DOCUMENTS

| | | | |
|---|---|---|---|
| CN | 201023675 | Y | 2/2008 |
| CN | 102026874 | A | 4/2011 |

(Continued)

OTHER PUBLICATIONS

European Search Report issued by the European Patent Office in connection with EP16159411 dated Apr. 15, 2016.

(Continued)

*Primary Examiner* — Edward T Tolan

(74) *Attorney, Agent, or Firm* — Levenfeld Pearlstein, LLC

(57) ABSTRACT

A tool for sealing overlying courses of a strap that includes a gripping unit, a power supply unit detachably affixed to one end of the gripping unit, and a motor in the gripping unit. A cam is coupled to the motor and a notching unit is coupled to the cam by a plurality of linkages.

28 Claims, 8 Drawing Sheets

(56) References Cited

U.S. PATENT DOCUMENTS

| | | | | |
|---|---|---|---|---|
| 4,595,433 | A * | 6/1986 | Ford | B29C 66/1122 100/33 PB |
| 5,632,851 | A * | 5/1997 | Young | B65B 13/327 100/29 |
| 6,308,745 | B1 | 10/2001 | Angarola et al. | |
| 6,338,184 | B1 | 1/2002 | Angarola et al. | |
| 6,354,580 | B1 * | 3/2002 | Nagai | B25B 5/12 269/225 |
| 6,422,272 | B1 | 7/2002 | Crittenden | |
| 6,470,941 | B1 * | 10/2002 | Wehr | B29C 65/02 156/358 |
| 2002/0139085 | A1 * | 10/2002 | Kasel | B65B 13/18 53/399 |
| 2002/0148274 | A1 * | 10/2002 | Goop | B21D 39/04 72/416 |
| 2004/0237807 | A1 * | 12/2004 | Pearson | B65B 13/04 100/26 |
| 2006/0272381 | A1 | 12/2006 | Ayer et al. | |
| 2008/0289516 | A1 * | 11/2008 | Takidis | B23K 11/115 100/8 |
| 2011/0155277 | A1 * | 6/2011 | Coles | B65B 13/285 140/93.6 |

FOREIGN PATENT DOCUMENTS

| | | | |
|---|---|---|---|
| CN | 101391661 | B | 6/2011 |
| DE | 1185532 | B | 1/1965 |
| DE | 1536210 | B | 9/1970 |
| DE | 29507452 | U1 | 7/1995 |
| DE | 102009001544 | A1 | 10/2010 |
| EP | 1413519 | A1 | 4/2004 |
| GB | 896398 | A | 5/1962 |

OTHER PUBLICATIONS

International Search Report and Written Opinion for International Application No. PCT/US2012/058405, dated Jan. 4, 2013.

* cited by examiner

SEALING TOOL FOR STRAP

CROSS-REFERENCE TO RELATED APPLICATION DATA

This application is a continuation of U.S. patent application Ser. No. 13/618,686, filed Sep. 14, 2012, the disclosure of which is incorporated herein by reference.

This application claims the benefit of priority of Provisional U.S. Patent Application Ser. No. 61/543,161, filed Oct. 4, 2011, the disclosure of which is incorporated by reference in its entirety.

BACKGROUND

Manual sealers provide positive sealing action with minimal effort. They interlock overlapping courses of a strap into a high strength joint. One type of sealing tool is a manual notch-type sealer that cuts into and seals the outer edges of the strap, turning tabs down (down notch) or up (reverse notch). Crimp-type sealers press the edges of the strap and the seal into wavy crimps especially shaped to produce maximum frictional forces on the strap.

There are two principal types of manual strap sealers, front action sealers and side action sealers. Front-action sealer handles are held perpendicular to the strap, usually in front of the operator who forces the handles together for maximum leverage. These are generally used for light duty strap applications. Side-action sealers have a lower handle that can be rested on the flat surface of the load being strapped. Operators can apply much of their weight, again for maximum leverage, with both hands on the upper handle. These are generally used in heavier strap applications.

The joint is the weakest part of the system, therefore the type of joining method used is very important if strength is an issue. The strength of a joint is defined as the force required to break the strap in uniaxial tension. This is then compared to the uniaxial strength of the strap and recorded as the percent difference (e.g., a sample of strap may have a 5,000 lb (2,300 kg) break strength and the seal may fail at 3,750 lbs. (1,750 kg), so the seal is said to have a 75% strength). Hot knife welds have a minimum break strength of 55%. Friction welds have a minimum break strength of 65%.

SUMMARY

Various embodiments of the present disclosure provide a sealing tool for sealing a strap, comprising a gripping unit, a power supply unit detachably affixed to one end of the gripping unit, and a motor in the gripping unit. The tool can include a cam coupled to the motor, and a notching unit coupled to the cam by a plurality of linkages where the notching unit is configured to create a notch in a strap.

In an embodiment, the power supply unit is a battery. The notching unit can be configured to create a notch in a strap. A gear can be coupled to the motor which drives the cam.

In another embodiment, the notching unit includes a notch plate having a first notch surface at a first depth in the notch plate and a second notch surface surrounding the first notch surface at a second depth in the notch plate. The notch plate can be configured to create a notch in a strap. The tool can include a push button switch coupled to the motor and the power supply unit.

A strap position indicating switch can be included in the notching unit that provides power to the motor when a strap is positioned in the sealing tool. A home position switch can also be provided to sense that the notching unit is at the home or full open position at the end of a sealing cycle.

The notching unit can include a first linkage having a first end coupled to the cam, a second linkage and a third linkage each having a first end coupled to the second end of the first linkage, a first jaw rotatably affixed to a second end of the second linkage, and a second jaw affixed to a second end of the first linkage, such that the first jaw and second jaw are rotatably affixed to the notch plate so that pincers located at ends of each of the jaws face each other.

A method of operating a sealing tool includes the steps of receiving an operation signal from a switch, receiving a signal from a strap sensor indicating that a strap is positioned in a notch plate, providing power from a power supply unit to a motor in a gripping unit, and driving a notching unit via a cam coupled to the power supply unit to create a notch in the strap.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
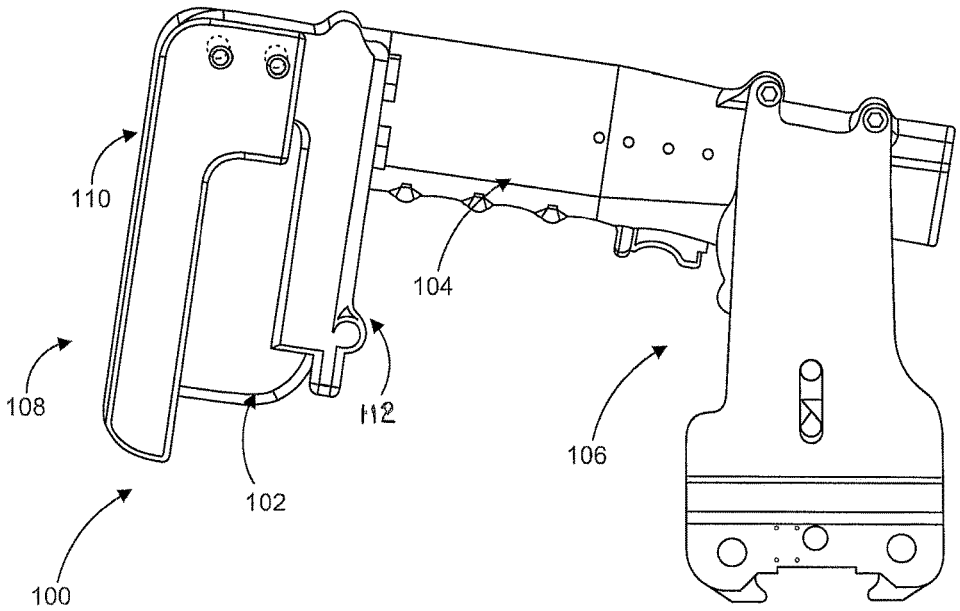
FIG. 1 is a side view of an embodiment of a sealing tool.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 illustrates an embodiment of a sealing tool 100. The tool 100 includes a power supply unit 102, a grip handle 104 and a notcher assembly 106. In one embodiment, the grip handle 104 and notcher assembly 106 are manufactured from a strong, but lightweight material including, but not limited to, aluminum, magnesium, titanium, or any other light weight material.

The power supply unit 102 can be a lithium-ion or nickel cadmium battery having an operational voltage of about 14.4 to 24 volts inclusive. The power supply 102 is removably affixed to a first end of the grip handle 104 by a holding unit 108. In one embodiment, the holding unit 108 includes a first plate 110 that is affixed to a second plate 112. An upper surface of the second plate 112 is affixed to the first end of the grip handle 104. The first plate 110 and second plate 112 are separated by a distance sufficient to accommodate batteries of varying sizes. A locking unit (not shown), holds the first plate 110 against the second plate 112 such that the power supply unit 102 is prevented from disengaging the grip handle 104. In another embodiment, the power supply unit 102 is removably secured to the grip handle 104 by a locking clip (not shown) on the grip handle 104 which engages an opening on a side of the power supply unit 102.

Figure 2A:
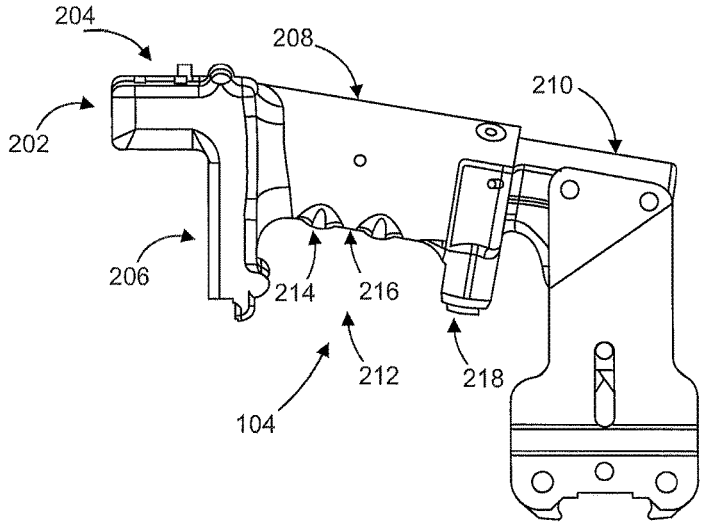
FIGS. 2A and 2B illustrate a grip handle on the sealing tool of FIG. 1.

FIG. 2A illustrates an embodiment of a grip handle 104. The grip handle 104 includes the first end 202 that includes a first extension 204 which is collinear with the central axis of the grip handle 104 and a second extension 206 which is substantially perpendicular to the central axis of the grip handle 104, a central portion 208 and a top portion 210. The first extension 204 and second extension 206 are configured to accommodate the battery holding unit 108. The first extension 204 includes a plurality of openings which each correspond to openings in the first plate 110 and second plate 112 such that the first plate 110 and second plate 112 are affixed to the first extension 204. In one embodiment, the second extension acts 206 as the second plate.

The central portion 208 of the grip handle 104 includes a grip area 212 which includes a plurality of raised areas 214 and corresponding lower areas 216. The lower areas 216 are spaced from the raised areas 214 such that the lower areas 216 can comfortably accommodate a user's finger. Further, the depth of the lower areas 216 in relation to the raised areas 214 are set to a depth which prevents a user's finger from moving parallel with the central axis of the grip handle 104. In one embodiment, the central portion 208 includes an interior channel that is manufactured using a single bore housing. By using a single bore housing, the diameter of the central portion 208 is reduced which allows for a user hand to comfortably engage the grip area 212 and the back surface of the central portion 208. The central portion 208 can be manufactured of two half sections which are sealed together using a sealing unit including, but not limited to, screws, bolts, pins, clasps, rivets or any other mechanism for securing the two halves together.

A push button switch 218 is positioned between the top portion 210 and the grip area 212. The switch 218 is positioned such that an operator can simultaneously engage the grip area 212 and the switch 218. When activated, the switch 218 completes a circuit between the power supply unit 102 and a motor (see, for example 302, FIG. 3) in the top portion 210 as will be described herein. In one embodiment, the front portion of the switch 218 is curved to comfortably accommodate a user's finger.

Figure 2B:
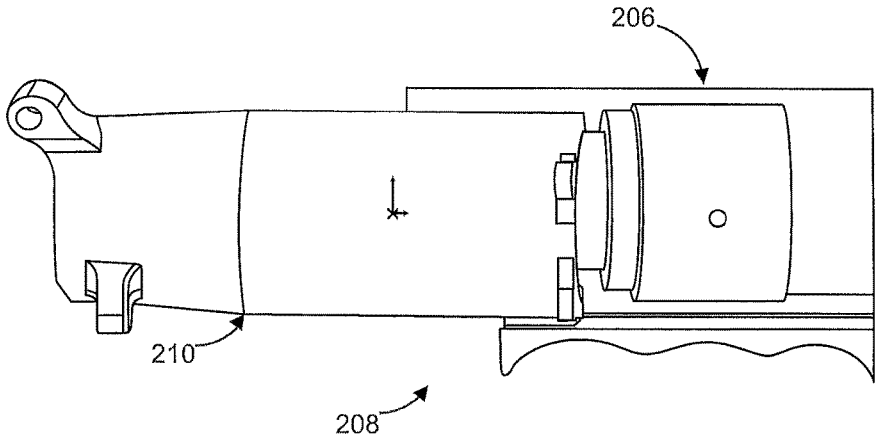

The top portion 210 of the grip handle 104 includes a first end affixed to the central portion 208. In one embodiment, the first end of the top portion 210 engages an opening in the center portion 206 as shown in FIG. 2B. The opening is sized to engage the first end of the top portion 210. A central channel 300 extends through the top portion 210 along a central axis of the top portion 210.

Figure 3:
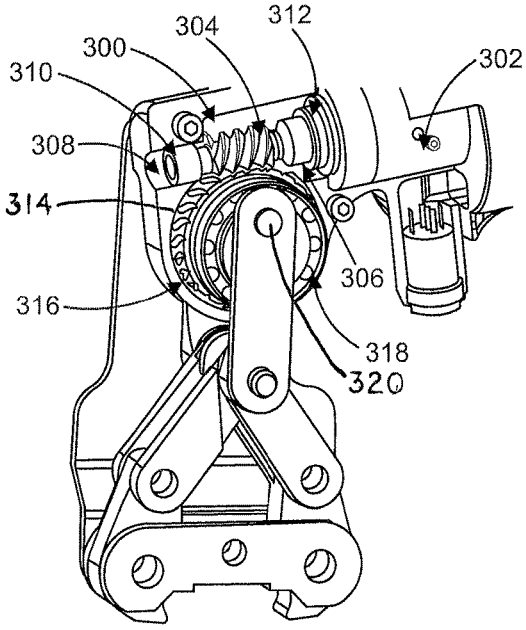
FIG. 3 illustrates a central channel of the sealing tool of FIG. 1.

FIG. 3 shows an embodiment of a central channel 300 in the grip handle 104. The central channel 300 includes a rear portion 306 which is sized to accommodate the motor 302 and worm gear 304 and a front portion 308 which is sized to accommodate the top end of the worm gear 304. In one embodiment, the front portion 308 includes a bearing 310 that engages the top end of the worm gear 304 such that the worm gear 304 freely rotates around its central axis. A rear end 312 of the worm gear 304 is rotatably coupled to the motor 302 such that the motor 302 rotates the worm gear 304 about the worm gear's 304 central axis. A central gear 314 is positioned below the worm gear 304 in a side cavity 316 of the top portion. The central gear 314 includes a plurality of teeth which are sized to engage the worm gear 304. An inner portion of the central gear 314 is affixed to a cam 318 which is affixed to the notcher assembly 106.

Figure 4:
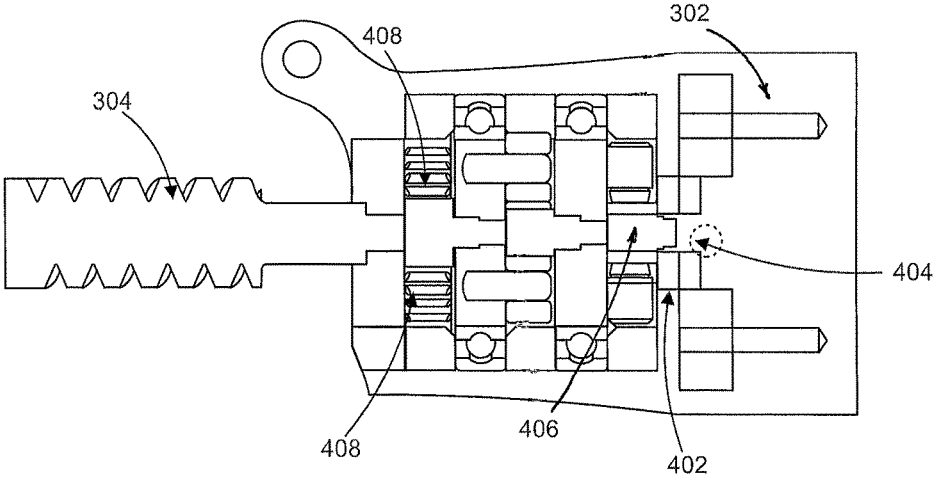
FIG. 4 depicts the motor positioned in the central channel of FIG. 3.

FIG. 4 illustrates an embodiment of the motor 302. The motor 302 is affixed to a plate 402 on the rear portion 306 of the central channel 300 of the top portion 210. The plate 402 includes an opening 404 that is sized to accommodate a plurality of connectors coupled to the power supply unit 102 and the switch 218. The axle 406 of the motor 302 includes a plurality of teeth that engage and drive a planetary gear set 408. In one embodiment, the motor 302 includes three planetary gears 408 with each gear having four idler gears. The planetary gears 408 drive the worm gear 304 such that the worm gear 304 rotates around its central axis to drive the central gear 314.

Figure 5A:
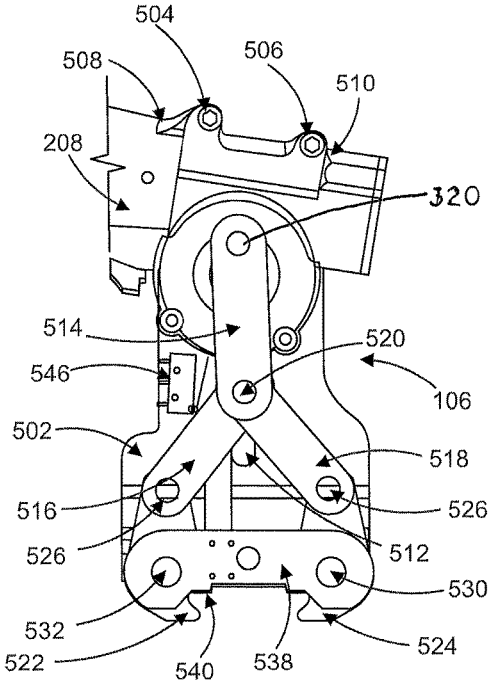
FIG. 5A is an embodiment of a sealing assembly of the sealing tool of FIG. 1.

FIG. 5A shows an embodiment of the notcher assembly 106. The notcher assembly 106 includes a back plate 502 affixed to one side of the top portion 210. The back plate 502 includes two openings 504, 506 positioned along a side of the back plate 502 which engage two openings in two extensions 508, 510 which extend from the surface of the top portion 210. The back plate 502 is on the top portion 210 such that the side cavity 316 is in front of the back plate 512 with the back plate 512 connecting to the two extensions 508, 510 which are positioned on a back surface of the top portion 210. A first end of a central linkage 514 is rotatably coupled to the cam 318 by a pin 320 such that the central linkage 514 rotates around the central axis of the cam 318 along a path defined by the periphery of the cam 318. A second end of the central linkage 514, distal from the first end of the central linkage 514, is rotatably coupled to a first end of a first positioning linkage 516 and a first end of a second positioning linkage 518 by a second pin 520. A second end of the first positioning linkage 516 is connected to a first end of a first jaw 522 and a second end of the second linkage 518 is connected to a first end of a second jaw 524. The back plate 502 includes a central slot 512 the width of which is sized to accommodate the second pin 520. The length of the central slot 512 is determined by the travel of the second pin 520. The pin 520 is slidably affixed to the slot 512 such that the second pin 520 travels along the slot 512 as the linkages are driven by the cam 318.

Figure 5B:
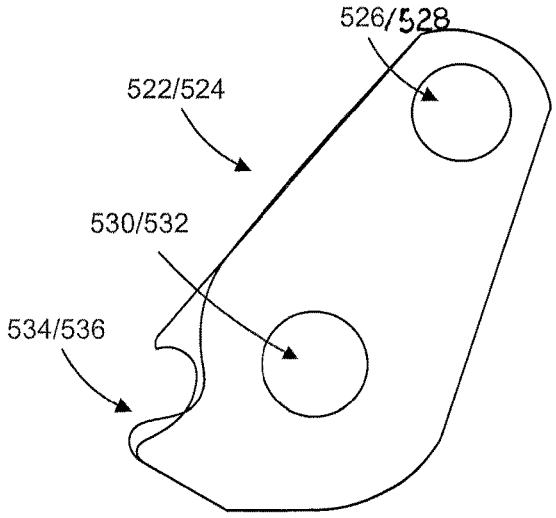
FIG. 5B illustrates the jaws of the sealing assembly of FIG. 5A.

FIG. 5B illustrates an embodiment of jaws 522 and 524. The jaws 522 and 524 include first openings 526 and 528, second openings 530 and 532 and pincers 534 and 536. The first openings 526 and 528 are each rotatably coupled to the second end of the first and second linkages 516 and 518 such that the jaws 522 and 524 rotate around the first opening 526 in each jaw 522 and 524. The second openings 530 and 532 are affixed to a front notch plate 538 and a back notch plate 540. The pincers 534 and 536 are arranged on the jaws 522 and 524 such that the pincer 534 on the first jaw 522 faces the pincer 536 on the second jaw 524. The pincers 534 and 536 are configured to rotate toward the strap to create a fold in a strap. In one embodiment, the pincers 534 and 536 press the sides of a strap toward a center portion of the notch plates 538 and 540 which creates a notch in the strap. Those skilled in the art will recognize that reference to "a notch" includes that configuration in which a notch is formed in opposing sides of the strap (i.e., two opposing notches are formed in the strap).

Figure 5C:
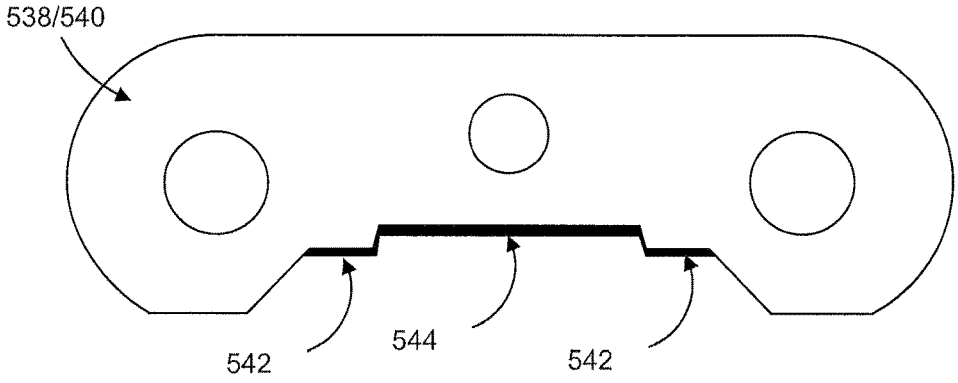
FIG. 5C illustrates the notch plates of the sealing tool of FIG. 1.

FIG. 5C shows an embodiment of the notch plates 538 and 540. The notch plates 538 and 540 each have a first opening and second opening on opposite ends which align with the second openings 530 and 532 in the jaws 522 and 524, such that the jaws 522 and 524 are separated by a predefined distance. The center of each notch plates 538 and 540 include a first notch surface 542 and at least two second notch surfaces 544. The first notch surface 542 is positioned at a first depth from the surface of the notch plate 538 or 540 with the second notch surfaces 544 being positioned at opposite ends of the first notch surface 542 and at a second depth. In an embodiment, the first notch surface 542 is positioned at a depth greater than the second notch surfaces 544. Alternately, the notch surfaces 542 and 544 are configured to create a notch in a strap. The notch levels 542 and 544 can be configured to create a single notch in a strap. In an embodiment, the strap has a width of at least 1.25 inches and a thickness of at least 0.025 inches.

Figure 6:
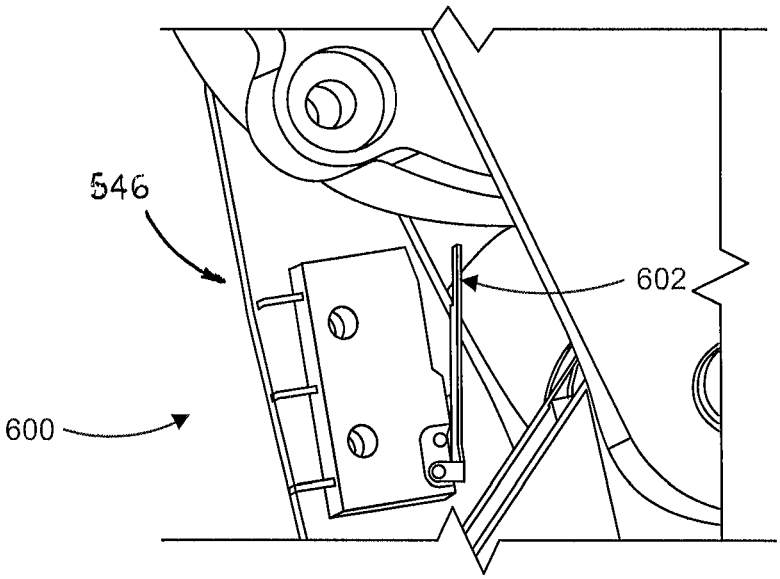
FIG. 6 illustrates a home position switch for the tool.

FIG. 6 illustrates an embodiment of a home position switch 546 included in the notcher assembly 106. The home position switch 546 is positioned on the back plate 512 and provides a signal to a control system (see, for example 800, FIG. 8) that the cam 318 has returned to a predetermined starting position. The home position switch 546 includes a base portion 600 with a sensor portion 602 attached to one side of the base portion 600. The sensor portion 602 is made from a material having memory and conductive characteristics such as, but not including, steel, copper or any other metal capable of bending and conducting electricity. The home position switch 546 is positioned on the back plate 512 such that one of the linkages 514, 516 and 518 contacts the sensor portion 602 when the linkages 514, 516 and 518 are in a predetermine position.

Figure 7:
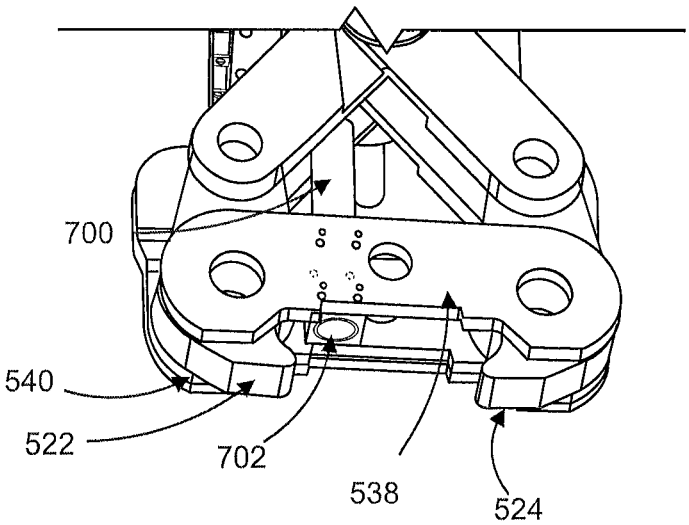
FIG. 7 depicts an exemplary sensor in the sealing assembly of FIG. 5A.

FIG. 7 illustrates an embodiment of a strap sensor 700. The sensor 700 is secured to the notch plates 538 and 540 such that the sensing portion 702 of the sensor 700 is in contact with a strap when a strap is positioned on the notch plates 538 and 540 for notching. When the sensor 700 is in contact with the strap, a current is inducted through the strap sensor 700 and back to a control system (see, for example 800, FIG. 8) indicating that a strap is in position on the notch plates 538 and 540. If the circuit is not complete, the sealing tool 100 is prevented from operating. In an embodiment, the sensor is an inductive sensor. Alternately, the sensor is a switch. The sensor 700 can be directly coupled to the power supply unit 102, to prevents the power supply unit 102 from powering the motor 302 without a strap present.

Figure 8:
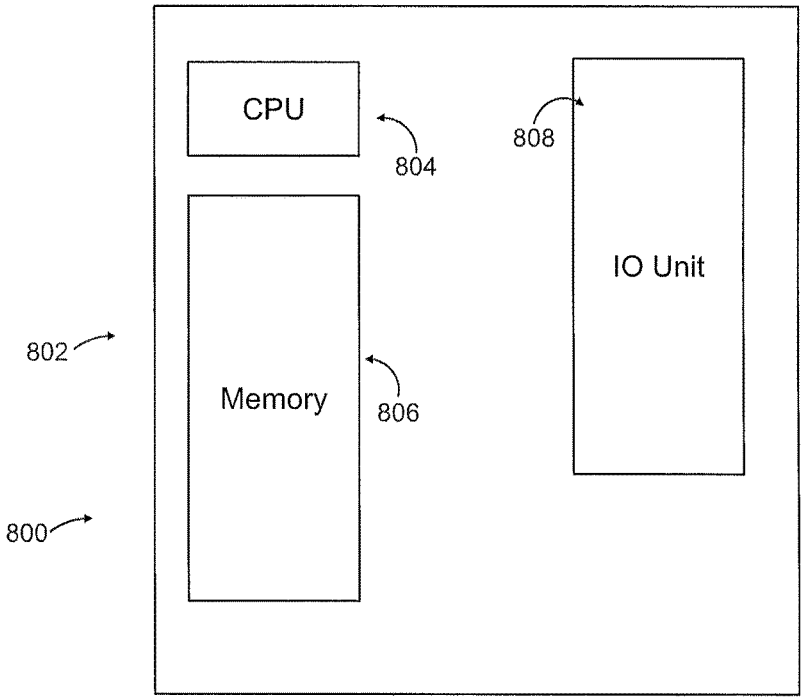
FIG. 8 illustrates a control system used to control the sealing tool of FIG. 1.

FIG. 8 depicts an exemplary control system 800 used to control the tool 100. The control system 800 includes a control panel 802 that includes a central processing unit ("CPU") 804, a memory 806 and an input and output ("I/O") unit 808. A plurality of sensors are electrically coupled to the I/O unit 808. Software operating in the CPU 804 monitors each of the plurality of sensors and controls the power from the power supply unit 102 to the motor 302 based on the inputs received from the sensors.

The switch 218, sensor 700 and home position switch 546 are connected as inputs to the control panel. Software operating in the CPU monitors the switch 218 to determine if the strap sealing tool 100 is in use. When the switch 218 is pressed, the software confirms the cam 318 has returned to the home position based on the home position switch 546. If the cam 318 has not returned to the home position, an output on the I/O unit 808 of the control panel 802 provides power to the motor 302 to move the cam 318 to the home position. Once the home position switch 546 confirms the cam 318 is in the home position, the software confirms a strap is positioned for notching by the sensor 700. If a strap is not in position for notching, no power is provided to the motor 302. If a strap is in position for notching, the output on the I/O unit 808 provides power to the motor 302 to drive the jaws 522 and 524.

Figure 9A:
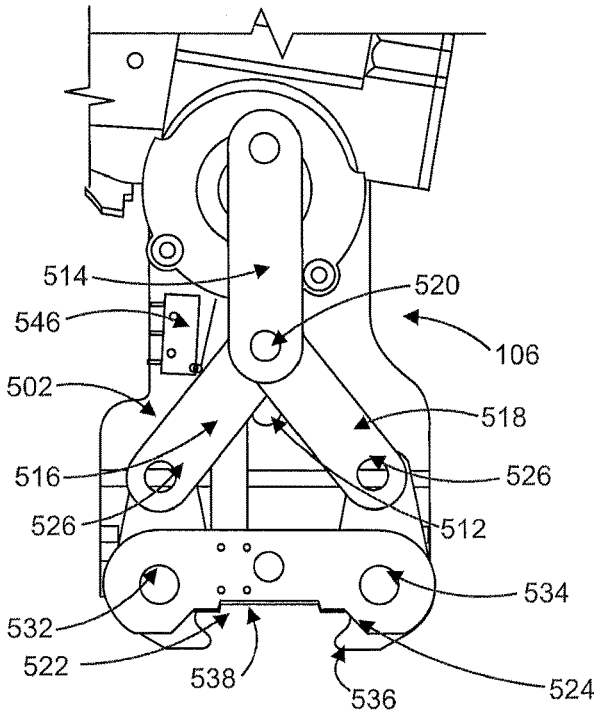
FIGS. 9A-9D shows the operation of the sealing tool.
Figure 9B:
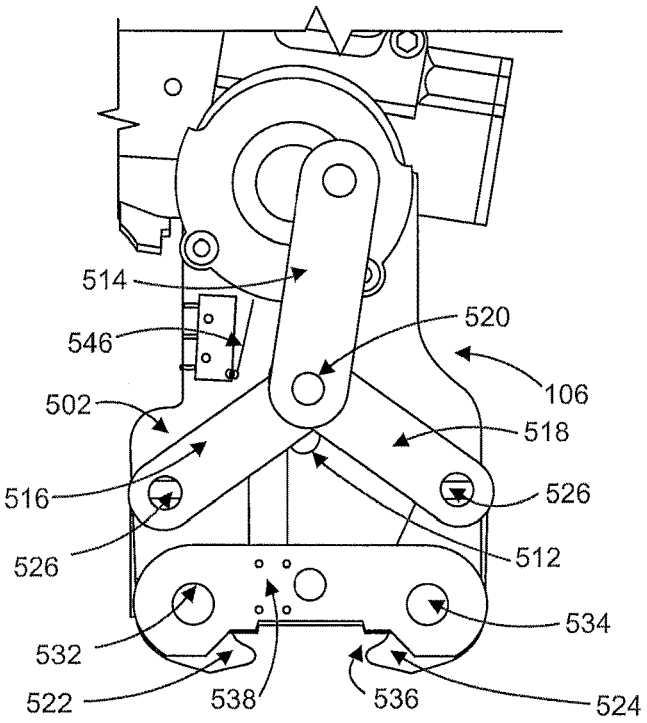
Figure 9C:
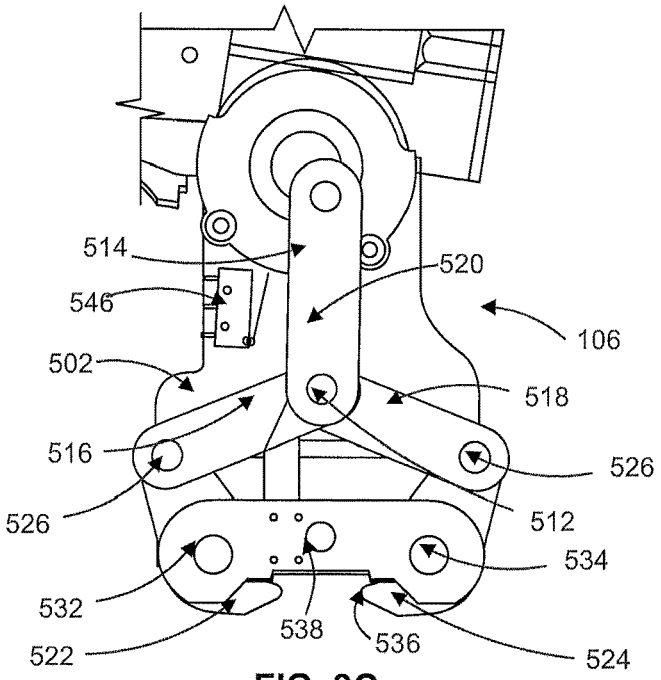
Figure 9D:
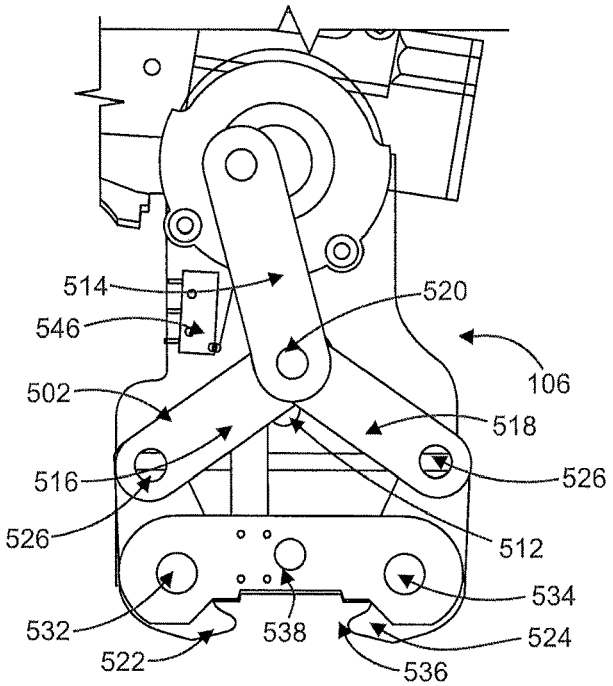

FIGS. 9A-9D illustrate the operation of the sealing tool 100. FIG. 9A depicts the sealing tool 100 in the full open position with the jaws 524 and 522 separated from each other by a maximum distance. When power is provided to the motor 302, the cam 318 rotates in a clockwise motion pushing the central linkage 514 down towards the notch plates 538 and 540. As the central linkage 514 moves downward, the first and second linkages 516 and 518 are pushed away from the central linkage 514 moving the jaws 522 and 524 towards the notch plates 538 and 540 as shown in FIG. 9B. When the cam 180 has rotated approximately 180 degrees from the starting position, the jaws 522 and 524 are in the full closed position which compresses the strap positioned against the notch plates 538 and 540, as shown in FIG. 9C. As the cam 318 moves beyond the 180 degree position and back towards the home position, the central linkage 514 is moved away from the notch plates 538 and 540 and the first and second linkages 516 and 518 are pulled towards the central linkage 514, which pushes the jaws 522 and 524 away from one another as shown in FIG. 9D.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

What is claimed is:

1. A hand-held sealing tool for sealing a strap, the sealing tool comprising:
   - a housing;
   - a battery detachably affixed to the housing;
   - a motor positioned at least in part in the housing;
   - a first jaw and a second jaw positioned on opposite sides of a strap path;
   - front and back notch plates positioned on opposing sides of the first and second jaws; and
   - a cam to which the motor is operably connected, wherein the motor is operably connected to the first jaw and the second jaw via the cam to rotate the first jaw and the second jaw relative to the front and back notch plates from an open configuration to a closed configuration to create a notch in the strap.

2. The sealing tool of claim 1, wherein each of the front and back notch plates has a first notch surface at a first depth in the notch plate and a second notch surface at a second depth in the notch plate, wherein the second depth is different than the first depth.

3. The sealing tool of claim 1, further comprising a sensor positioned between the front and back notch plates and configured to detect the presence of a metallic object in the strap path.

4. The sealing tool of claim 3, wherein the sensor is positioned above the strap path.

5. The sealing tool of claim 3, wherein the metallic object comprises the strap and the sensor comprises a strap sensor.

6. The sealing tool of claim 3, further including a controller configured to control the motor, wherein the sensor is configured to send a signal to the controller.

7. The sealing tool of claim 6, wherein the sensor is an inductive sensor and the controller is configured to permit operation of the motor when the metallic object is present in the strap path and contacts the sensor to complete an electrical circuit.

8. The sealing tool of claim 7, wherein the controller is configured to prevent operation of the motor when the metallic object is not present in the strap path such that the electrical circuit is open.

9. The sealing tool of claim 6 wherein the sensor is a switch.

10. The sealing tool of claim 6, further including a home position switch.

11. The sealing tool of claim 10, further including a linkage connected to the cam and operably connected to the first and second jaws, wherein the home position switch is positioned such that the linkage actuates the home position switch when the cam is in a predetermined position.

12. The sealing tool of claim 11, wherein the predetermined position is a home position in which the first jaw and the second jaw are in the open configuration.

13. The sealing tool of claim 8, further comprising an actuatable operating switch communicatively connected to the controller, wherein the controller is configured to operate the motor responsive to an actuation of the operating switch when the metallic object is present in the strap path and contacts the sensor to complete the electrical circuit.

14. The sealing tool of claim 13, wherein the controller is not configured to operate the motor responsive to an actuation of the operating switch when the metallic object is not present in the strap path and the electrical circuit is open.

15. The sealing tool of claim 14, further including a linkage connected to the cam and operably connected to the first and second jaws and a home position switch positioned such that the linkage actuates the home position switch when the cam is in a predetermined position, wherein if the linkage is not contacting the home position switch when the operating switch is actuated, the controller is configured to operate the motor to move the first and second jaws to the open configuration.

16. The sealing tool of claim 1, further including one or more linkages operably connecting the cam to the first and second jaws.

17. The sealing tool of claim 16, wherein the first and second jaws are each rotatably connected to the front and back notch plates such that the front and back notch plates each connect the first and second jaws to one another.

18. The sealing tool of claim 17, wherein the motor is operably connected to the cam to rotate the cam, thereby causing the one or more linkages to rotate the first jaw and the second jaw from the open configuration to the closed configuration.

19. The sealing tool of claim 18, wherein the one or more linkages include a first linkage operably connected to the first jaw to rotate the first jaw and a second linkage operably connected to the second jaw to rotate the second jaw.

20. The sealing tool of claim 19, wherein the first linkage and the second linkage are connected to one another by a first pin.

21. The sealing tool of claim 20, wherein rotation of the cam about a cam rotational axis causes the first pin to move away from the cam rotational axis in a direction transverse to the cam rotational axis.

22. The sealing tool of claim 20, wherein the one or more linkages further comprise a central linkage that operably connects the cam to the first linkage and the second linkage.

23. The sealing tool of claim 22, wherein the central linkage is attached to the cam via a second pin and to the first and second linkages via the first pin such that rotation of the cam causes the second pin to move away from the cam, which in turn causes rotation of the first and second jaws from the open configuration to the closed configuration.

24. The sealing tool of claim 16, wherein the motor is positioned between the battery and the first and second jaws.

25. The sealing tool of claim 24, wherein a portion of the housing defines a channel in which the motor is positioned.

26. The sealing tool of claim 25, wherein the portion of the housing at least partially defines a handle.

27. The sealing tool of claim 1, further including:

a first linkage connected to the first jaw;

a second linkage connected the second jaw, wherein the cam is operably connected to the first linkage and the second linkage;

a pin connecting the first linkage and the second linkage; and a controller configured to control the motor to rotate the cam about a cam rotational axis, which causes the pin to move away from the cam rotational axis and force the portions of the first and second linkages connected to the first and second jaws to move outward, which causes the first and second jaws to rotate from the open configuration to the closed configuration, wherein a portion of the housing positioned between the battery and the first and second jaws defines a channel in which the motor is positioned.

28. A hand-held sealing tool for sealing a strap, the sealing tool comprising:

a housing;

a battery detachably affixed to the housing;

a motor positioned at least in part in the housing;

a notching unit drivable by the motor and having a first jaw and a second jaw positioned on opposite sides of a strap feed path, the notching unit also having front and back notch plates positioned on opposing sides of and operably connecting the first and second jaws;

a strap sensor positioned between the front and back notch plates and configured to detect the presence of a strap in the strap feed path;

a controller configured to control the motor and configured to receive a signal from the strap sensor;

a cam to which the motor is operably connected;

a linkage connected to the cam and operably connected to the notching unit; and a home position switch positioned such that the linkage actuates the home position switch when the cam is in a home position in which the first jaw and the second jaw are in an open configuration.

* * * * *